US007364281B2

(12) United States Patent
Yan

(10) Patent No.: US 7,364,281 B2
(45) Date of Patent: Apr. 29, 2008

(54) TINY AIR-PRESSURE BALANCE DEVICE BETWEEN AN INK CARTRIDGE AND AN INK BOTTLE

(76) Inventor: Yi-Tsung Yan, P.O. Box 96-405, Taipei 106 (TW)

( * ) Notice: Subject to any disclaimer, the term of this patent is extended or adjusted under 35 U.S.C. 154(b) by 352 days.

(21) Appl. No.: 11/256,071

(22) Filed: Oct. 24, 2005

(65) Prior Publication Data

US 2006/0187280 A1 Aug. 24, 2006

(30) Foreign Application Priority Data

Feb. 23, 2005 (TW) ..... 94202844 U

(51) Int. Cl.
*B41J 2/175* (2006.01)

(52) U.S. Cl. ..... 347/85; 347/86

(58) Field of Classification Search ..... 347/84, 347/85, 86; 222/386, 387
See application file for complete search history.

(56) References Cited

U.S. PATENT DOCUMENTS 4,992,802 A * 2/1991 Dion et al. ..... 347/87
6,017,118 A * 1/2000 Gasvoda et al. ..... 347/86
6,719,418 B2 * 4/2004 Chou et al. ..... 347/87

* cited by examiner

*Primary Examiner*—Anh T. N. Vo
(74) *Attorney, Agent, or Firm*—Troxell Law Office, PLLC

(57) ABSTRACT

A tiny air-pressure balance device between an ink cartridge and an ink bottle, in which the ink cartridge is connected with an ink tube extended to one side of the printer; every ink tube is connected with the outlet of the ink bottle; the upper part of the ink bottle is mounted with a balance device, in which a tiny air-pressure check valve is mounted so as to have a tiny air enter for balancing the pressure in the ink bottle upon the printer printing words or drawings, and to prevent the water in the ink bottle from volatilizing away.

8 Claims, 11 Drawing Sheets

TINY AIR-PRESSURE BALANCE DEVICE BETWEEN AN INK CARTRIDGE AND AN INK BOTTLE

BACKGROUND OF THE INVENTION

1. Field of the Invention

This invention relates to a printer, and particularly to a tiny air-pressure balance device between an ink cartridge and an ink bottle in a printer.

2. Description of the Prior Art

In a conventional supply system of a conventional printer, the upper part of every color ink cartridge is connected with a connector, and every connector is connected with a ink tube, of which the other end extends to one side of the printer; the tail end of the ink tube is connected with a connector on the lid of an outside ink bottle (container). The ink in the ink bottle flows into the ink cartridge via the ink tube to form into a supply system so as to enable a printer to print words or drawings.

In the continuous supply system of a conventional printer, the ink bottle mounted outside the printer is a single lid type; the upper part of the bottle lid is furnished with a threaded connector, of which the outer end is connected with an ink tube, while the inner end thereof is connected with a tube extended into the bottle of the ink bottle; the bottle lid must be turned loose or drill a hole in the bottle lid before the ink in the bottle able to flow into the ink cartridge of a printer.

The lid of an outside ink bottle is usually drilled a hole, or is turned loose; however, since the ink is a soluble liquid; the density of the ink would be increased as a result of varying ambient temperature and humidity, and the loss of water in the ink; in that case, the printing quality of the nozzle in the printer would be affected; usually; the nozzle would fail to spray ink, or become useless.

In the conventional separate-type ink cartridge, the outlet of the ink cartridge is furnished with a check valve, which includes a rubber plug, a valve and a spring. By means of the resilience of the spring, the valve and the rubber plug can be maintained in a close contact condition; therefore, the ink in the ink cartridge would not leak out. After the ink cartridge is mounted to the printer, a push rod on the ink cartridge base would push the valve to an open condition; then, the ink would flow, through the gap between the valve and the rubber plug, into the ink passage.

SUMMARY OF THE INVENTION

The prime object of the present invention is to provide a tiny air-pressure balance device mounted over a seal member in a cylindrical hole of an ink bottle; the seal member is furnished with two independent cylindrical holes, of which one is connected with a suction pipe extended to the bottom of the ink bottle, and the outer end of the suction pipe is connected with a L-shaped connector; of which the other end is connected with an ink tube; the other end of the ink tube is connected with the ink cartridge; during printing, the ink in the ink bottle would flow, through the suction pipe, and the L-shaped connector, into the ink cartridge for printing operation.

Another object of the present invention is to provide a tiny air-pressure balance device mounted over a seal member in a cylindrical hole of an ink bottle; the seal member is furnished with two independent cylindrical holes, of which one is connected with a connection assembly; the inside of the connection assembly is mounted with a balance device to provide a tiny air-pressure check function; during printing operation, the balance device will have a suitable amount of air entered the ink bottle to provide the ink bottle with a balance and steady air pressure.

Still another object of the present invention is to provide a tiny air-pressure balance device mounted in the connection assembly; the balance device can provide a one way tiny pressure check function so as to have the water in the ink not volatilized to affect the printing quality no matter the variation of the ambient temperature or low humidity around the printer.

A further object of the present invention is to provide a seal member mounted on the bottle mouth of the ink bottle, which has two independent cylindrical holes; the connection assembly and the L-shaped connector mounted on the bottle mouth of the ink bottle are independent parts respectively.

A still further object of the present invention is to provide a seal member mounted on the mouth of the ink bottle, and the seal member is furnished with two through cylindrical holes; the connection assembly and the L-shaped connector are cast into one piece.

Yet another object of the present invention is to provide a seal member mounted on the mouth of the ink bottle; the center of the seal member is furnished with two through cylindrical holes, and the outer edge thereof is furnished with a seal ring, which can prevent the ink in the ink bottle from leaking upon a threaded lid being mounted on the bottle during shipping.

Yet still another object of the present invention is to provide a connection assembly mounted to the tail end of the ink tube; when an ink bottle is replaced, the only thing to do is to remove the connection assembly, and to plug the same on the mouth of a new ink bottle; the replacing operation is simple and easy.

Yet a further object of the present invention is to provide a seal member mounted on the mouth of the ink bottle; after the seal member is connected together with the connection assembly, the ink in the ink bottle will be isolated from the atmosphere; if the ink bottle is turned over, the ink would not leak out from the connection part, or from the one way tiny air-pressure check valve.

Yet a still further object of the present invention is to provide a connection assembly connected with the tail end of the ink tube; by means of the seal member mounted on the mouth of the ink bottle, the connection assembly is connected in place via two cylindrical holes thereof.

Yet a still another object of the present invention is to provide a connection assembly connected with the tail end of the ink tube; the seal member is mounted on the mouth of an ink bag first to facilitate the connection assembly to plug into the two cylindrical holes in the seal member.

DETAILED DESCRIPTION OF THE PREFERRED EMBODIMENT

Figure 1:
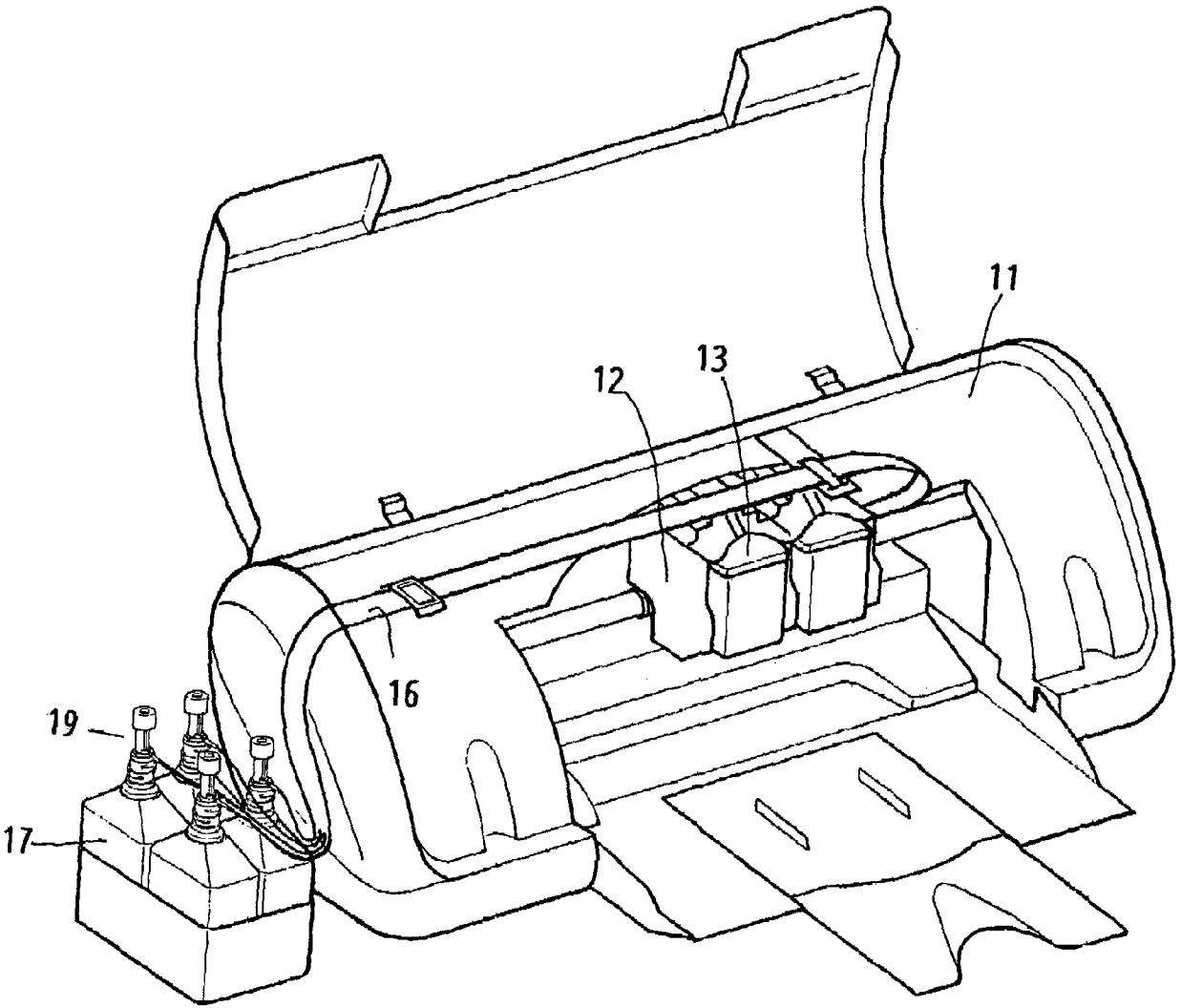
FIG. 1 is a perspective view of a continuous ink-feeding system for a printer according to the present invention.
Figure 6:
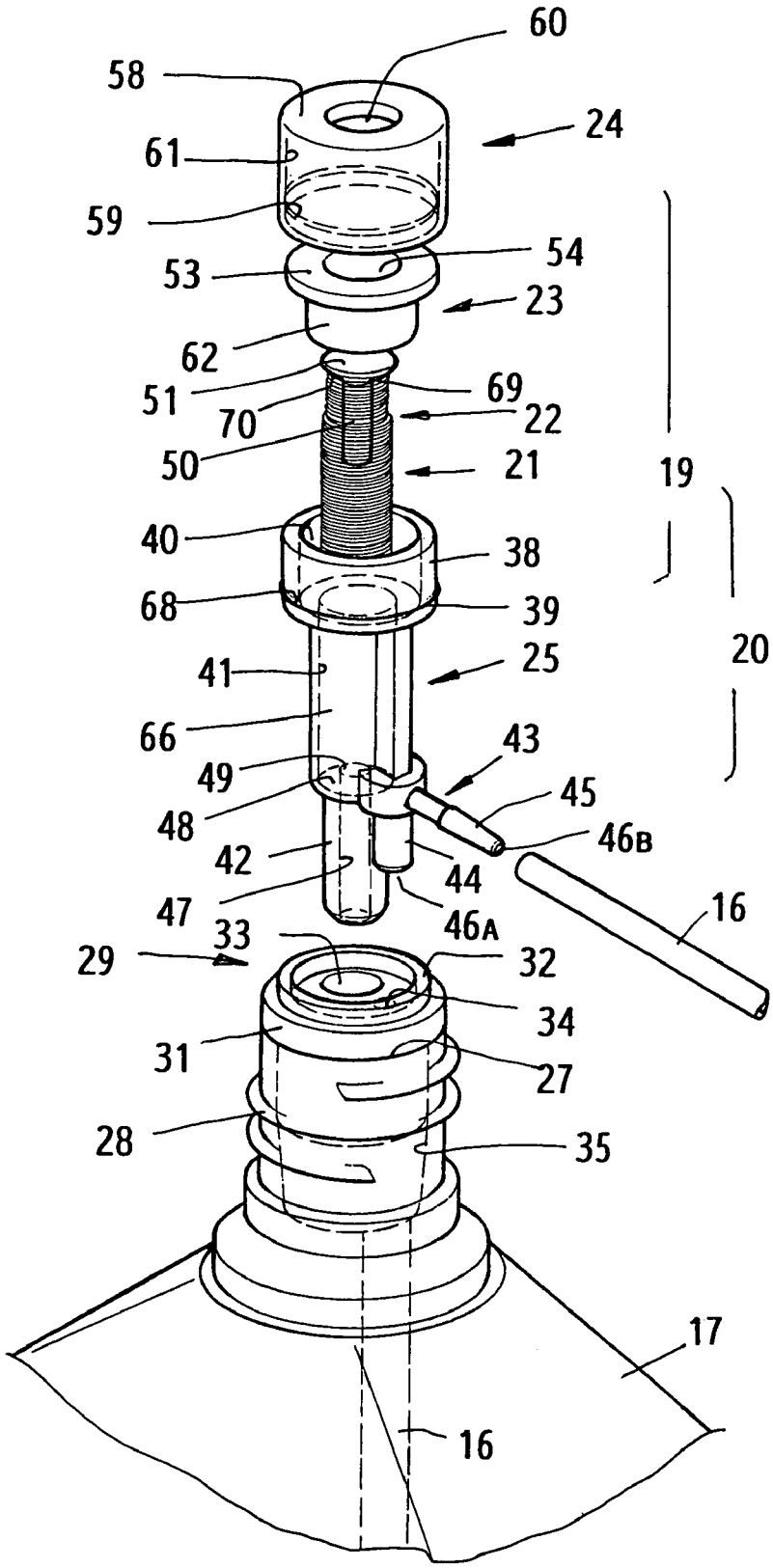
FIG. 6 is a disassembled view of the present invention, showing the assembled structure of the connection assembly.

This invention relates to a tiny-air-pressure balance device between an ink cartridge and an ink bottle; as shown in FIGS. 1 and 6, an ink cartridge 13 is mounted on the ink cartridge base 12 of a printer 11. The top part of each color cartridge is mounted with a L-shaped connector, which is connected with an ink tube 16; the ink tube is positioned in place with a support frame; the other end of the ink tube 16 is extended to one side of the printer 11; another ends of the ink tubes 16 arranged in parallel are connected respectively with the L-shaped connectors 43 of the connection assembly 20; another end of every connection assembly 20 is plugged into a cylindrical hole (33 or 34) of a seal member 29 on the ink bottle 17 having a given color. The ink bottle 17 filled with ink is connected with the ink cartridge 13 on the printer 11 via the connection assembly 20 and the ink tube 16. The ink in the printer 11 is used for printing words or drawings, and it would cause a tiny negative pressure in the ink bottle 13; such tiny negative pressure would guide and push the ink in the bottle 17 to flow into the ink cartridge 13.

Figure 2:
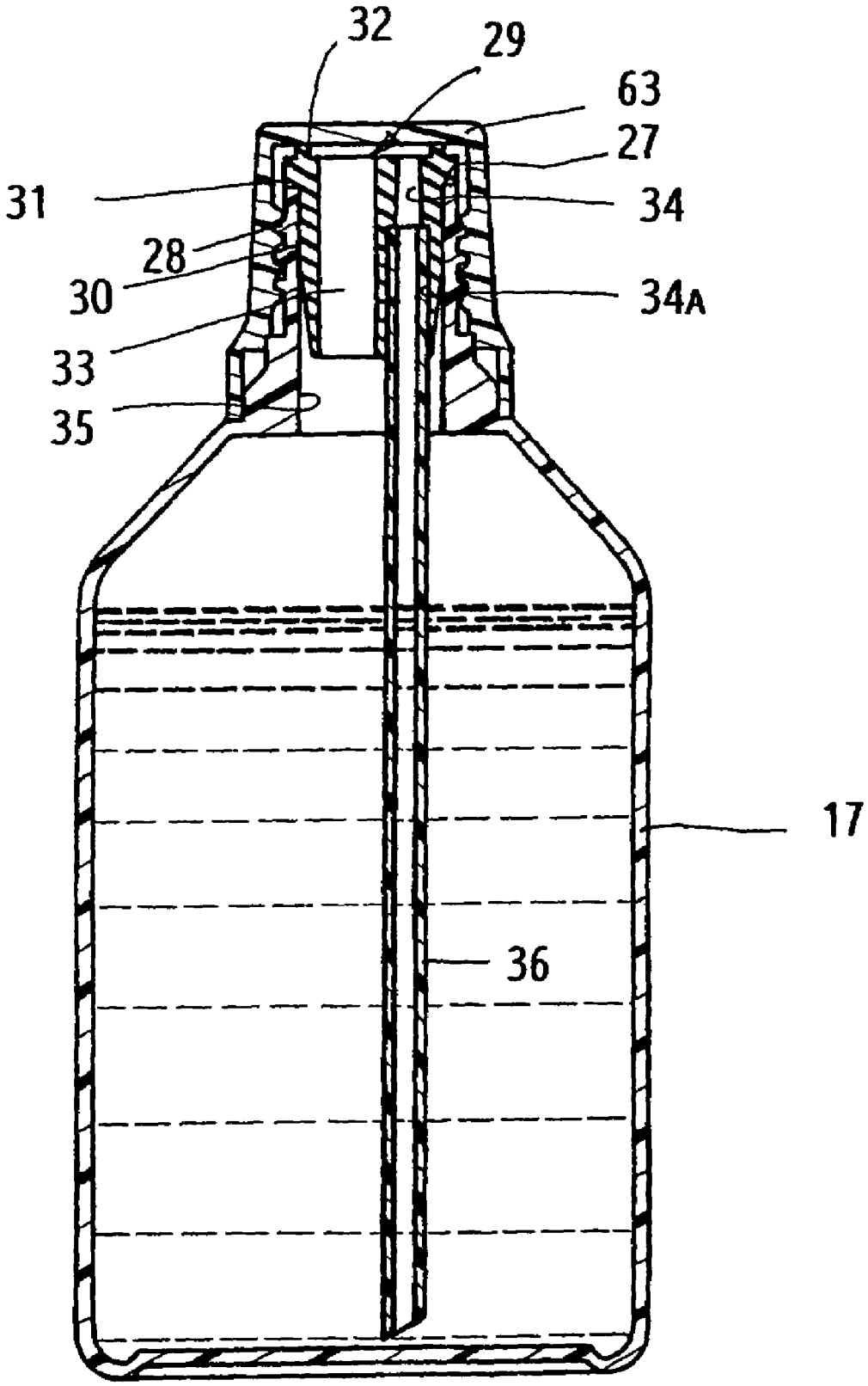
FIG. 2 is a sectional view of the present invention, showing a single ink bottle sealed.
Figure 3:
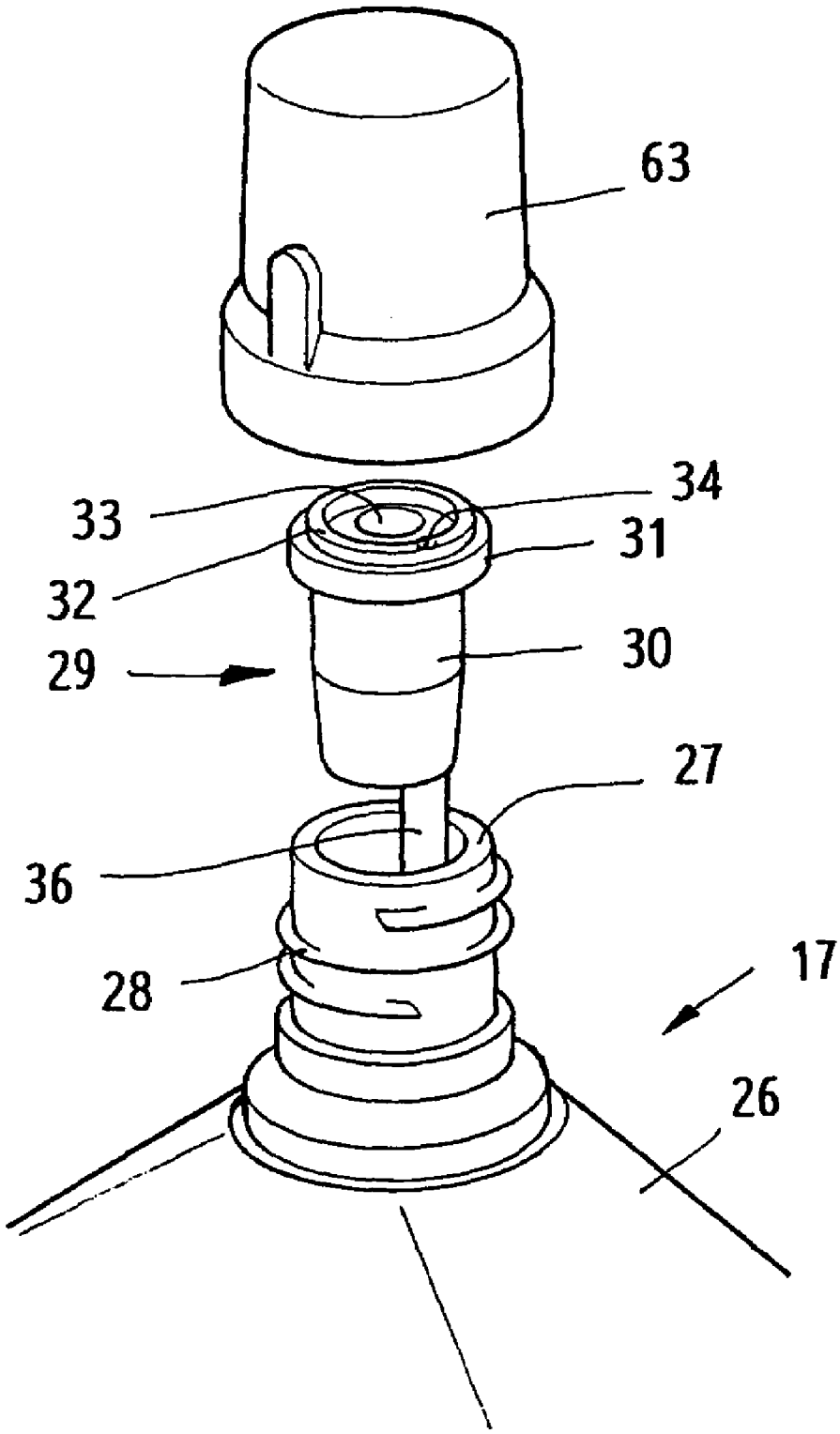
FIG. 3 is a disassembled view of the present invention, showing an assembly on top of the ink bottle.
Figure 4:
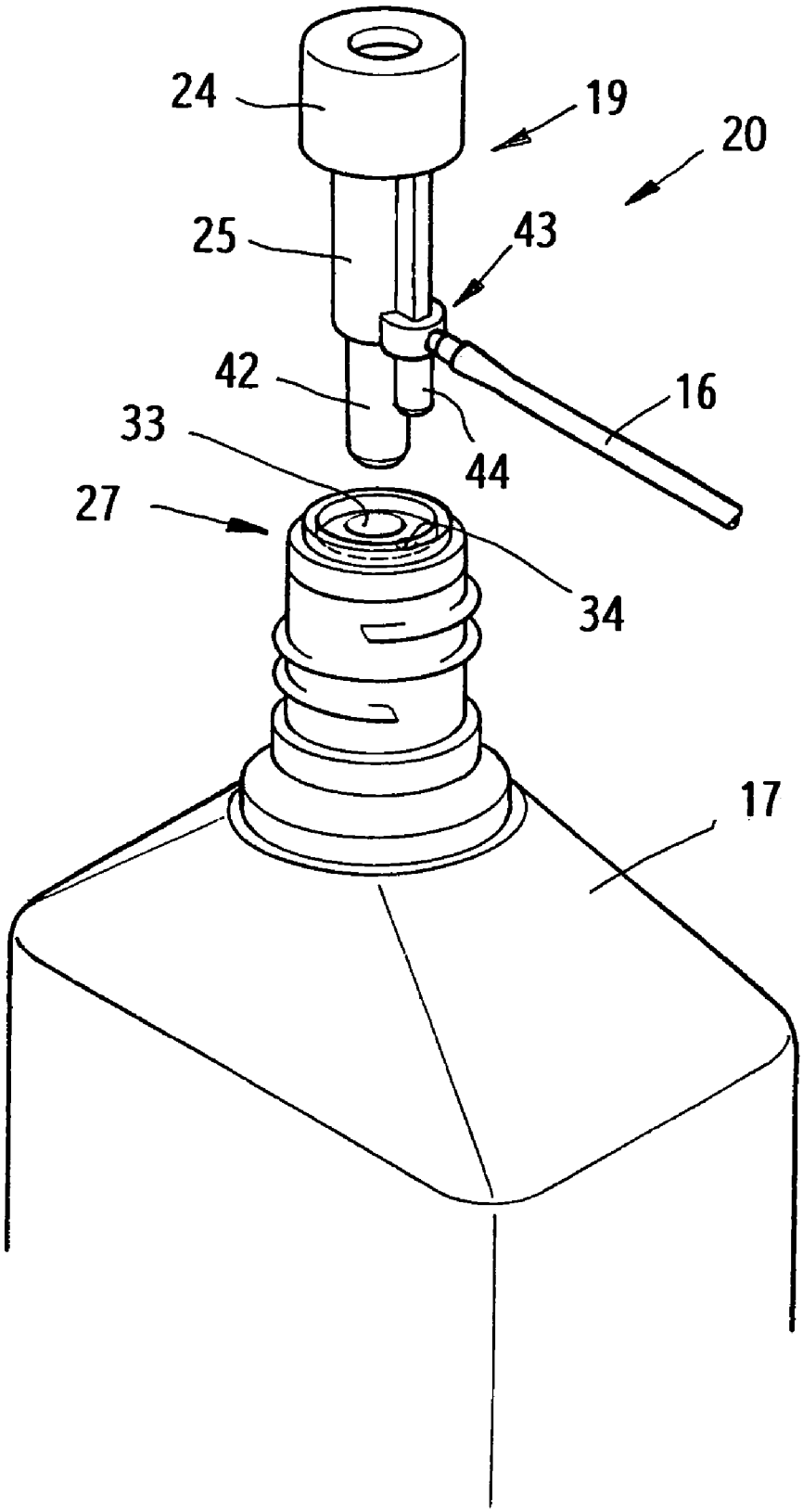
FIG. 4 is a disassembled view of the present inventions, showing the assembled relation between the ink bottle and the connection assembly.

Referring to FIGS. 1 to 3, the ink bottle 17 on the printer 11 is sealed with a seal member 29 mounted in a cylindrical hole 35 by means of threads 28 and a threaded lid 63 before the ink bottle 17 being used.

The seal member 29 plugged into the bottle mouth 27 of ink bottle 17 is furnished with a round surface 30 in contact with the cylindrical hole 35; the round surface 30 has a partition ring 31, of which the diameter is equal to that of the bottle mouth 27 of the ink bottle 17. After the seal member 29 is mounted to the bottle mouth 27 of the bottle 17, the partition ring 31 will be in close contact with the outer surface of the bottle mouth 27; the seal member 29 has a seal ring 32 above the partition ring 31; the inside of the seal member 29 is furnished with two through cylindrical holes 33 and 34; the cylindrical hole 34 has a larger inner cylindrical hole 34*a* for mounting a suction pipe 36; after the seal member 29 is mounted in the bottle mouth 27 of the ink bottle 17, one end of the suction pipe 36 will extend to the bottom of the ink bottle 17.

Figure 5:
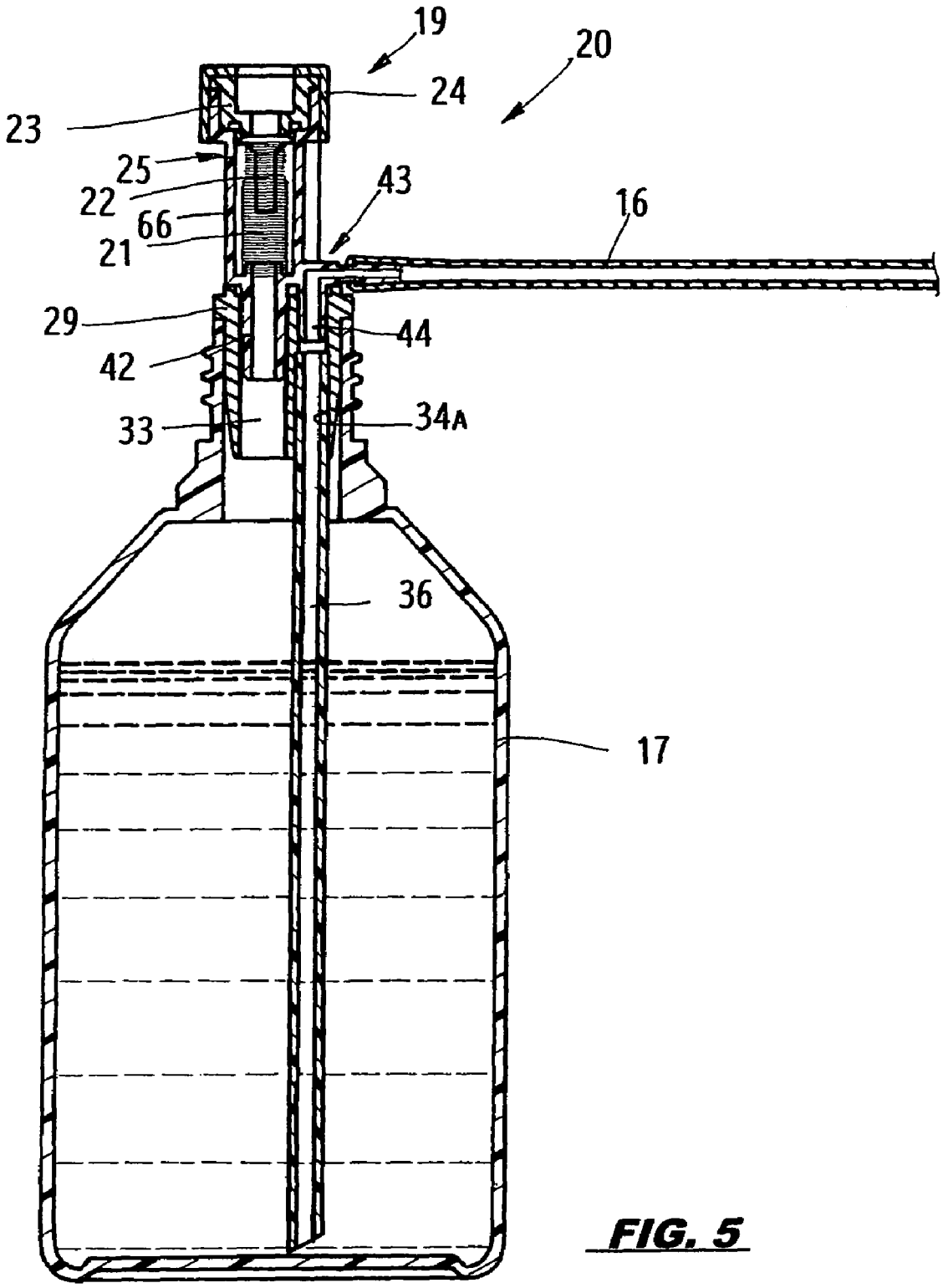
FIG. 5 is a sectional view of the present invention, showing the assembled relation between the ink bottle and the connection assembly.
Figure 7:
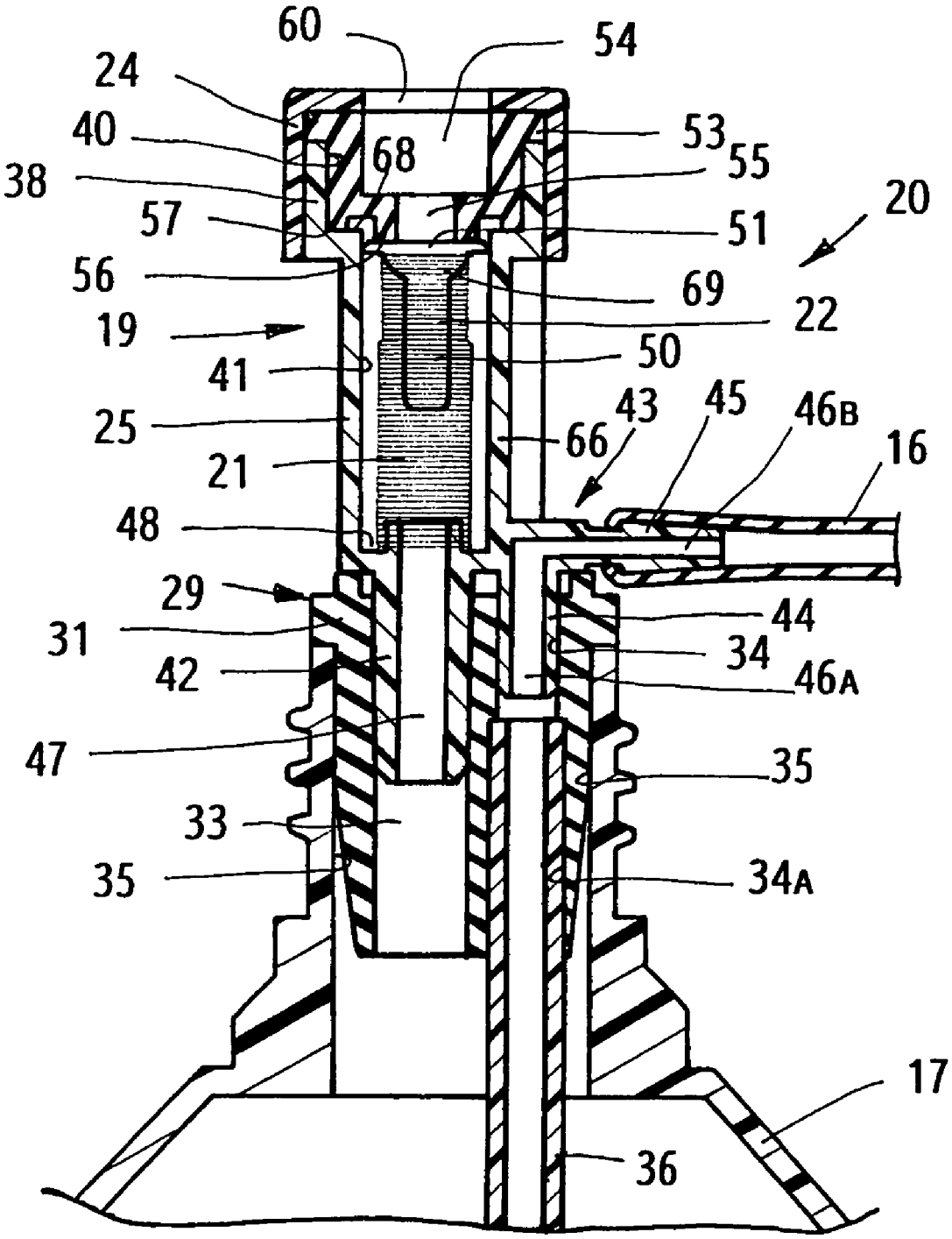
FIG. 7 is a sectional view of the present invention, showing an enlarged fragmental view of FIG. 5.

Referring to FIGS. 5 to 7, the ink bottle 17 is filled with ink; before the connection assembly 20 is mounted in place, the two cylindrical holes 33 and 34 of the seal ring 32 are through holes; the cylindrical hole 34 has an inner cylindrical hole 34*a* with a larger diameter, and the suction pipe 36 connected with the inner cylindrical hole 34*a* will extend to the bottom of the ink bottle 17; after the connection assembly 20 is plugged into the seal ring 32, the ink will flow upwards along the suction pipe 36.

Figure 8:
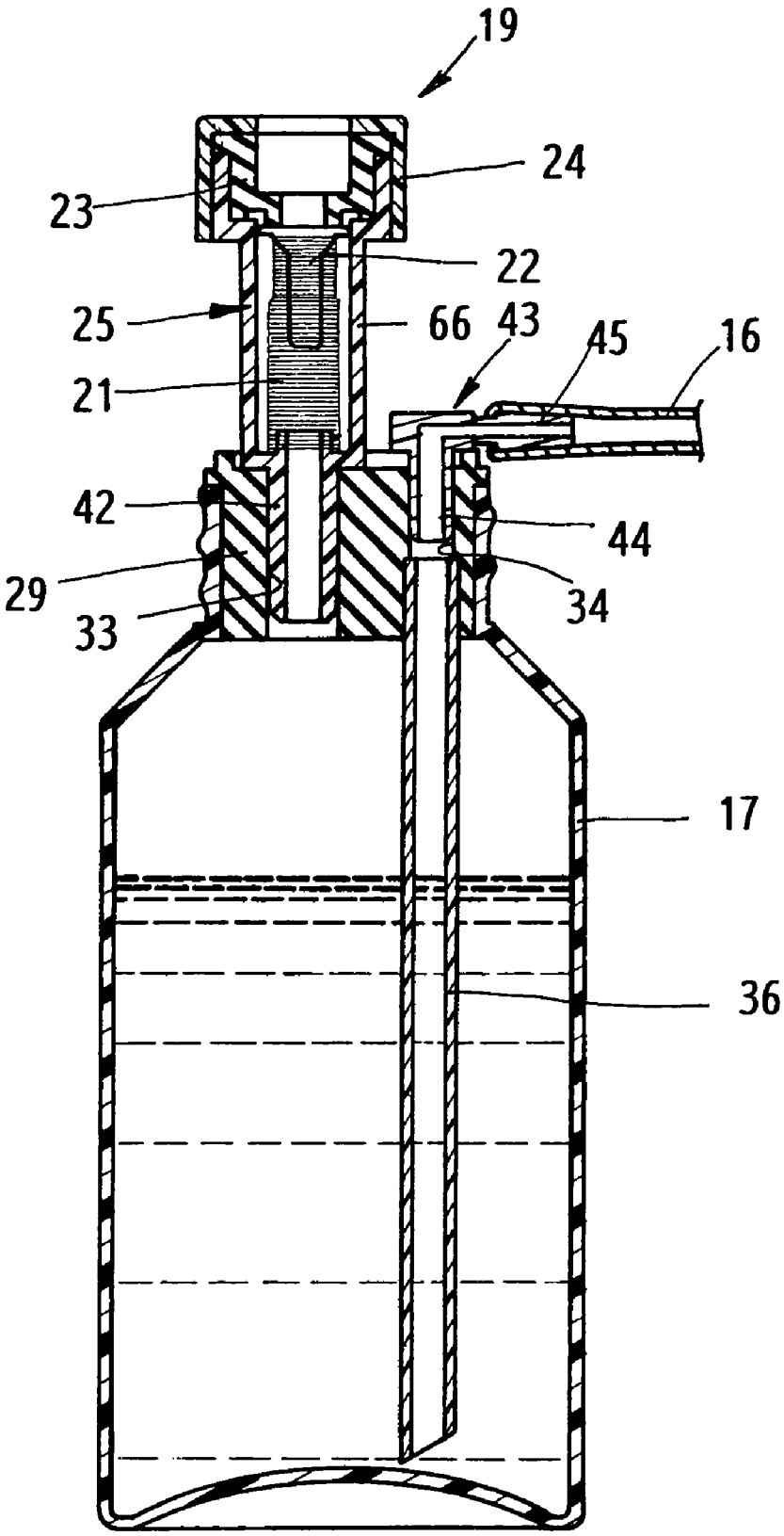
FIG. 8 is a sectional view of the present invention, showing the balance device and the ink-output end being mounted on the same bottle mouth separately.
Figure 9:
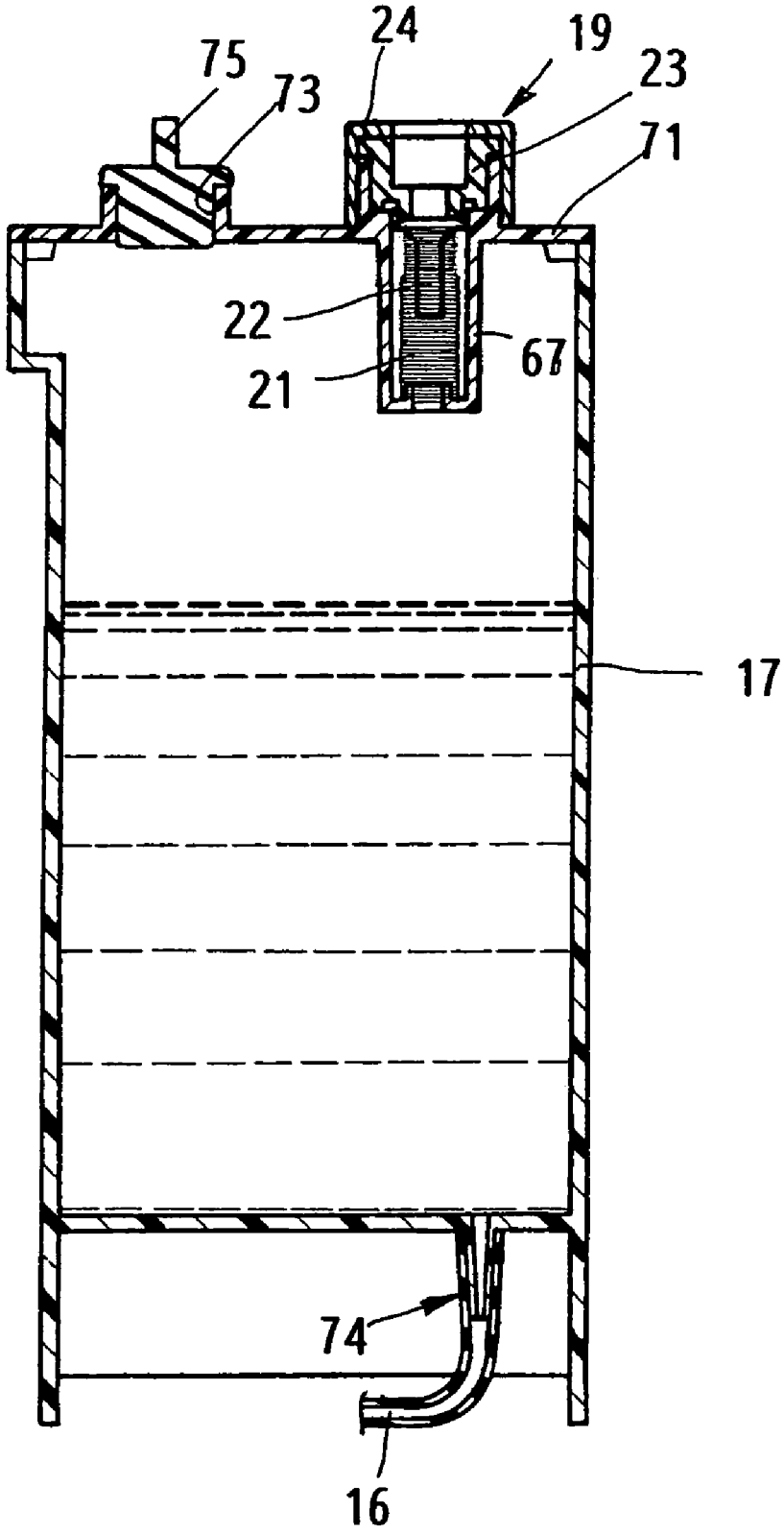
FIG. 9 is a sectional view of the present invention, showing the balance device and the ink-output end being mounted to different positions respectively.

The connection assembly 20 on the seal ring 32 of the ink bottle 17 includes a balance device 19 mounted in the cylindrical hole 33, and a L-shaped connector 43. As shown in FIGS. 5 and 6, the L-shaped connector 43 and the outer body of the balance device 19 are built into one assembly; as shown in FIGS. 8 and 9, the balance device 19 is mounted on the upper part of the ink bottle 17, of which the output end is to be designed in accordance with the shape of the ink bottle 17; the ink in the bottle 17 is to be fed into the ink cartridge 13 by means of the ink tube 16.

Referring to FIGS. 1, 5 to 7, the connection assembly 20 on the ink bottle 17 includes the balance device 19 and the L-shaped connector 43; the L-shaped connector 43 includes a plug rod 44 and a conic rod 45; the plug rod 44 has a center through hole 46A; the conic rod 45 also has a center through hole 46B; the two through holes 46A and 46B are formed into a L-shaped passage-way. The conic rod 45 of the L-shaped connector 43 is connected with the ink tube 16; the plug rod 44 is to be plugged into the cylindrical hole 34 of the seal ring 32 upon the connection assembly 20 being plugged in place so as to connect with the suction pipe 36 and to form into a separate passage-way.

The balance device 19 of the connection assembly 20 includes a body portion 25, a spring 21, a valve 22, a valve base 23 and an outer lid 24; the plug rod 42 is designed to fit in with the diameter of the cylindrical hole 33 of the seal member 29; the plug rod 42 has a center through holes 47; after the balance device 19 is plugged into the two cylindrical holes 33 and 34 of the seal member 29, the plug rod 42 will be mounted on the seal ring 32 simultaneously.

The cylinder body 66 of the body portion 25 in the balance device 19 is furnished with a cylindrical hole 41, of which the lower part is in communication with the through hole 47 of the plug rod 42; the bottom of the cylindrical hole 41 is formed into a round surface 49, of which the center is formed into a ring-shaped recess 48. The top of the cylinder body 66 of the body portion 25 has a cylinder body 38 with a larger diameter; the inside of the cylinder body 38 also has a cylindrical hole 40 to be in communication with the cylindrical hole 41 of the cylinder body 66; the bottom of the cylindrical hole 40 has also a round surface 68. The cylindrical hole 41 of the body portion 25 is loaded with a spring 21, of which one end is positioned on the ring-shaped recess 48 under the cylindrical hole 41; the spring 21 has a given length; before the assembling procedure is completed, one end of the spring 21 extends into the center cylindrical hole 40 of the cylinder body 38.

The spring 21 in the balance device can furnished a one-way check effect upon the valve 22 and the valve base 23 being assembled together so as to provide a tiny pushing force. Before the valve 22 and the valve base 23 being assembled together, the spring extends into the cylindrical hole 40 of the body portion 25. As soon as the valve 22 is put on the spring 21, the weight of the valve 22 would press the spring 21 down slightly; upon the valve base 23 being out into the cylindrical hole 40 of the body portion 25, the seal ring 56 of the valve base 23 will be in contact with the valve 22; after the valve base 23 is positioned in place, the seal ring 56 on the bottom of the valve vase 23 will be in contact with the surface of the valve 22, and simultaneously the valve 22 will be pushed in place; then, the spring 21 will push the valve 22 with a tiny force so as to have the valve surface 51 of the valve 22 and the seal ring 56 of the valve base 23 contacted closely.

The valve 22 in the balance device 19 is mounted between the spring 21 and the valve base 23; the valve 22 includes a valve rod 50, a valve surface 51, and a short conic surface 69. The outer surface of the valve surface 51 may be a spherical surface or a flat surface, while the inside thereof is a flat surface 70; the center of the flat surface 70 is furnished with a valve rod 50 having a suitable length. Between the valve rod 50 and the flat surface 70 of the valve surface 51, there are a short conic surface 69 and a ring shaped flat surface. The valve surface 51 is designed to fit in with the seal ring 56 of the valve body so as to provide a close contact upon two parts being in contact with each other. The short conic surface 69 and a flat surface furnished between the valve rod 50 and the valve surface 51 are used for providing a center positioning function upon the valve 22 being in contact with the spring 21 so as to have the valve surface 51 and the seal ring 56 of the valve base 23 maintained in close contact.

The valve base 23 of the balance device 19 is mounted in the cylindrical hole 40 of the cylinder body 30 of the body portion 25, and it includes a U-shaped base 62, a ring flange 53, an inner seal ring 56 and an outer seal ring 57; the upper part of the U-shaped base 62 is furnished with a ring flange 53, while the lower part thereof is furnished with an outer seal ring 57; the center of the valve base 23 has a cylindrical hole 54, of which the bottom is furnished with a through hole 54, of which the bottom is furnished with a through hole 55; the outer surface of the through hole 55 has an inner seal ring 56; the valve base 23 is designed to fit to the cylindrical hole 40 of the cylinder body 38 on the body portion 25; after the valve base 23 is mounted into the cylindrical hole 40 of the cylinder body 38, the outer surface 52 of the U-shaped base 62 of the valve base 23 will be in close contact with the cylindrical hole 40, and then the seal ring 57 under the U-shaped base 62 and the round surface 68 at the bottom of the cylindrical hole 40 are in close contact with each other; the ring flange 53 of the U-shaped base 62 of the valve base 23 is mounted on the opening of the cylinder body 38. After the outer lid 24 is mounted in place, the ring flange 53 will become a seal ring between the two assemblies; a seal ring 56 is furnished under the through hole 55 on the bottom of the center cylindrical hole 54 of the U-shaped base 62 of the valve base 23, and it will be in close contact with the valve surface 51 of the valve 22 upon the valve base 23 being assembled in place; the valve 22 is normally pushed with the spring 21 so as to have the two assemblies maintained in a close contact state.

The outer lid 24 of the balance device 19 is designed into a cylinder shaped, and the center thereof has a round surface 61 to fit to the diameter of the cylinder body 38 on the body portion 25; the top of the outer lid has a round surface 58 with a through hole 60 having a suitable diameter. The outer lid 24 is to be mounted over the cylinder body 38 of the body portion 25; the inner surface of the round surface 58 is in contact with the outer surface of the ring flange 53 of the valve base 23. The round surface of the cylinder body 38 is furnished with a retaining ring 39; the inner round surface 61 of the outer lid 24 is also furnished with a retaining ring 59; the outer lid 24 is to be mounted to the cylinder body 38 by pressing method; in that case, a pushing force is applied to the ring flange 53 of the valve base 23 so as to increase the close contact effect between the two assemblies.

The ink bottle 17 with one bottle mouth is furnished with a seal ring 32 on the bottle mouth 27, and the upper part of the seal ring 32 has a cylindrical hole 34 for receiving the L-shaped connector 43; another cylindrical hole 33 of the bottle mouth is to be mounted with the balance device 19; the inner space of the ink bottle is a sealed space.

The conic rod 45 of the L-shaped connector 43 in the connection assembly 20 is to be connected with the ink tube 16, and the plug rod 44 thereof will be plugged into the cylindrical hole 34 upon the plug rod 42 being plugged into the cylindrical hole 33 in the seal ring 32, i.e., the two cylindrical holes 33 and 34 will be in close contact with the two plug rods 42 and 44 respectively without leaking.

After the connection assembly 20 is plugged on the top of the ink bottle 17, the L-shaped connector 43 at one side of the connection assembly 20 is connected with the ink cartridge 13 of the printer 11 through the ink tube 16. When the printer 11 is used for printing operation, the ink in the ink cartridge 13 will be consumed gradually; in that case, the inside of the ink cartridge 13 will generate a vacuum suction force, which can cause the ink in the ink tube 16 to flow into the ink cartridge 13; since the ink tube 16 and the L-shaped connector 43 are connected together, the ink in the ink bottle 17 will flow into the ink cartridge 13.

The ink in the ink bottle 17 can flow into the ink cartridge 13 through the suction pipe 36, the L-shaped connector 43 and the ink tube 16 by means of a vacuum suction force completely; the aforesaid suction force is very small; the valance device 19 on the ink bottle 17 can generate a tiny check force; when the inner space of the ink bottle 17 generate a tiny negative pressure, the valance device 19 will be opened; as soon as the balance effect takes place, it will be closed immediately so as not to affect the printing operation of the printer.

The connection assembly 20 on the ink bottle 17 has a L-shaped connector 43, of which one side is mounted with a balance device 19 including a body portion 25, a spring 21, a valve 22, a valve base 23 and an outer lid 24; the lower part of the body portion 25 has a plug rod 42 to be plugged into the cylindrical hole 33 of the seal member 29; by means of a pushing-force between the spring 21 and the valve 22, the valve 22 and the valve base 23 can be in close contact with each other. During printing operation, the ink in the ink bottle 17 will flow out to generate a tiny negative pressure to cause the valve surface 51 of the valve 22 to separate from the valve base 23; in that case, a tiny air would enter the ink bottle 17 so as to balance the negative pressure therein; when the printer 11 is running continuously, the ink bottle 17 will generate a tiny negative pressure continuously, and then, the valve 22 and the valve base 23 will be separated continuously and immediately so as to facilitate a tiny air to enter the ink bottle 17. As long as the inner pressure of the ink bottle 17 is under a balance condition, the valve 22 and the valve base 23 will be in a close contact condition. The balance device 19 is substantially a one-way valve of the tiny air; in other words, the balance device will provide a one-way tiny air supply always so as to maintain a normal pressure in the ink bottle 17.

The connection assembly 20 on the seal member 29 of the ink bottle 17 includes a balance device 19 and a L-shaped connector 43; the two assemblies are cast into one piece; the outer end of the L-shaped connector 43 is connected with an ink tube 16, which is connected with the ink cartridge 13; the balance device 19 can provide a one-way tiny pressure check function. If the ink bottle 17 is put on a level which is slightly lower than the position of the printer 11, the ink in the ink cartridge 13 would not have a siphon effect, i.e., the ink would flow back into the ink bottle 17.

The ink in the ink bottle 17 is a soluble liquid, which would be volatilized slightly as a result of temperature and humidity. If there is no air-pressure balance device furnished for the ink bottle 17, the printer 11 would be unable to work. If the ink bottle 17 is furnished with a tiny hole to have air entered the bottle, the ink in the ink bottle 17 would also have a tiny volatile condition as a result of variation of temperature and humidity. If the printer 11 has not a great printing volume, the density of the ink would be increased gradually as a result volatility effect; in that case, the quality of the printer 11 would be poor; seriously, the ink nozzle of the printer 11 would be blockaded.

Referring to FIG. 8, it shows the second embodiment of the present invention, in which the valance device 19 and the L-shaped connector 43 are separated from each other; a seal member 29 is plugged into the cylindrical hole 35 of the bottle mouth 27 of the ink bottle 17. The seal member 29 includes two through cylindrical holes 33 and 34; the balance device 19 is plugged into the cylindrical hole 33, while the L-shaped connector 43 is plugged in the plug rod 44; the L-shaped connector 43 is connected with the ink cartridge via the ink tube. The balance device 19 mounted on the seal member 29 is used for balancing the pressure in the ink bottle 17 so as to prevent the water liquid therein from volatilizing.

Referring to FIG. 9, it shows the third embodiment of the present invention, in which the body portion 25 of the balance device 19 and the top lid 71 of the ink bottle 17 are cast into one piece; one side of the top lid 71 is furnished with a cylinder body 67, which is loaded with a spring 21, a valve 22 and a valve base 23; the top thereof is covered with the outer lid 24; one side of the top lid 71 is furnished with a balance device 19, while the other side thereof is furnished with an ink-filling hole 73 and a seal lid 75. After the ink bottle 17 is filled up, the ink-filling hole will be sealed. The bottom of the bottle body 72 of the ink bottle 17 is furnished with an outlet 74 to be connected with the ink tube 16 and to the inlet of the ink cartridge. During printing operation, the ink will be consumed gradually; in that case, the balance device 19 will have a suitable amount of air flowed into the ink bottle 17 via the seal lid; simultaneously, the liquid in the ink bottle 17 would not volatilize, and the printing quality would not be affected. The cylinder body 67 on one side of the ink bottle 17 has an independent cylindrical hole; the balance device 19 is an independent member as shown in FIG. 8. The balance device 19 is directly plugged in an independent cylindrical hole on the ink bottle 17, but it can provide a one-way tiny pressure check function.

Figure 10:
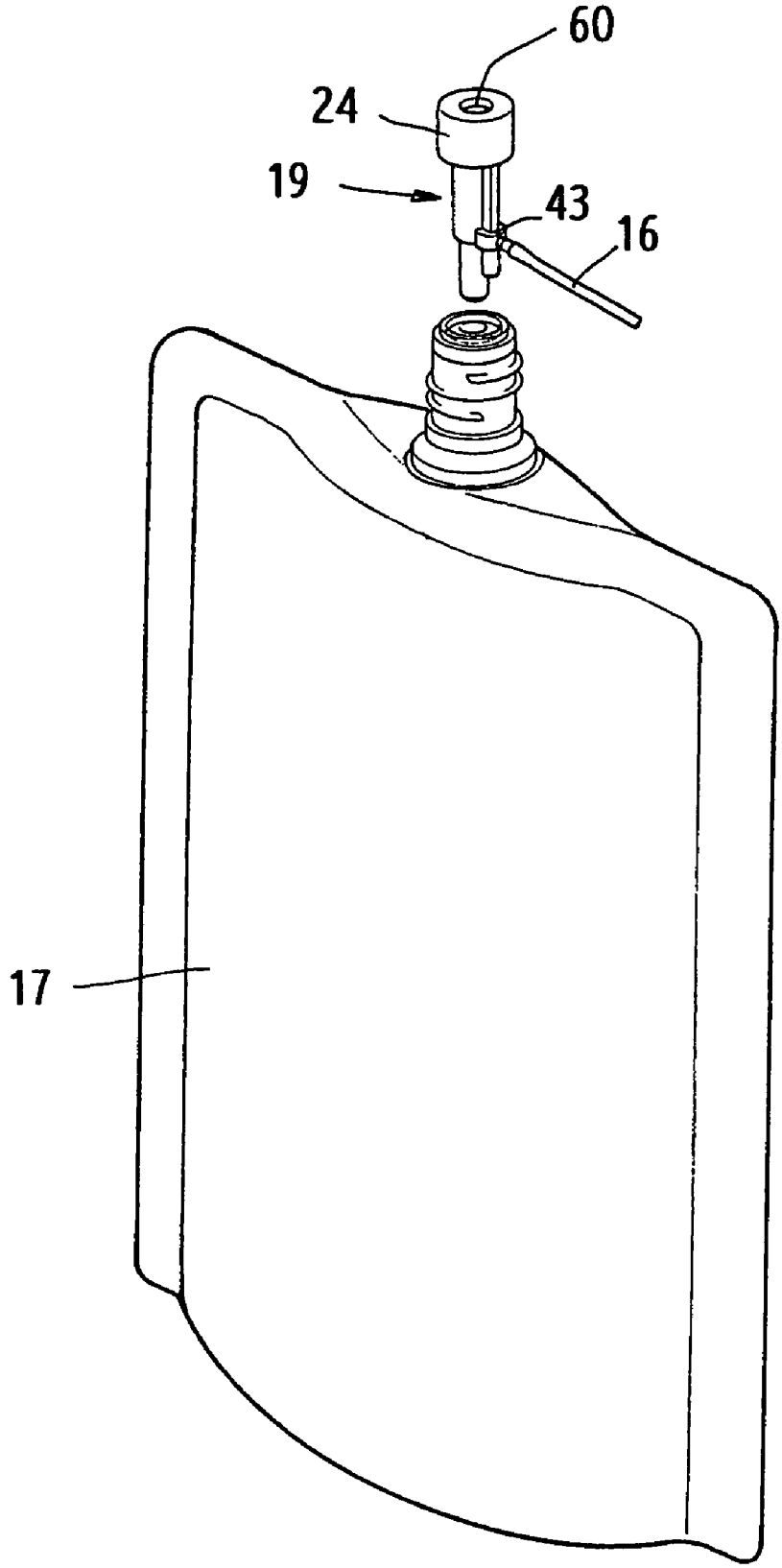
FIG. 10 is a perspective view of the present invention, in which the ink bottle is substantially an aluminum foil bag.
Figure 11:
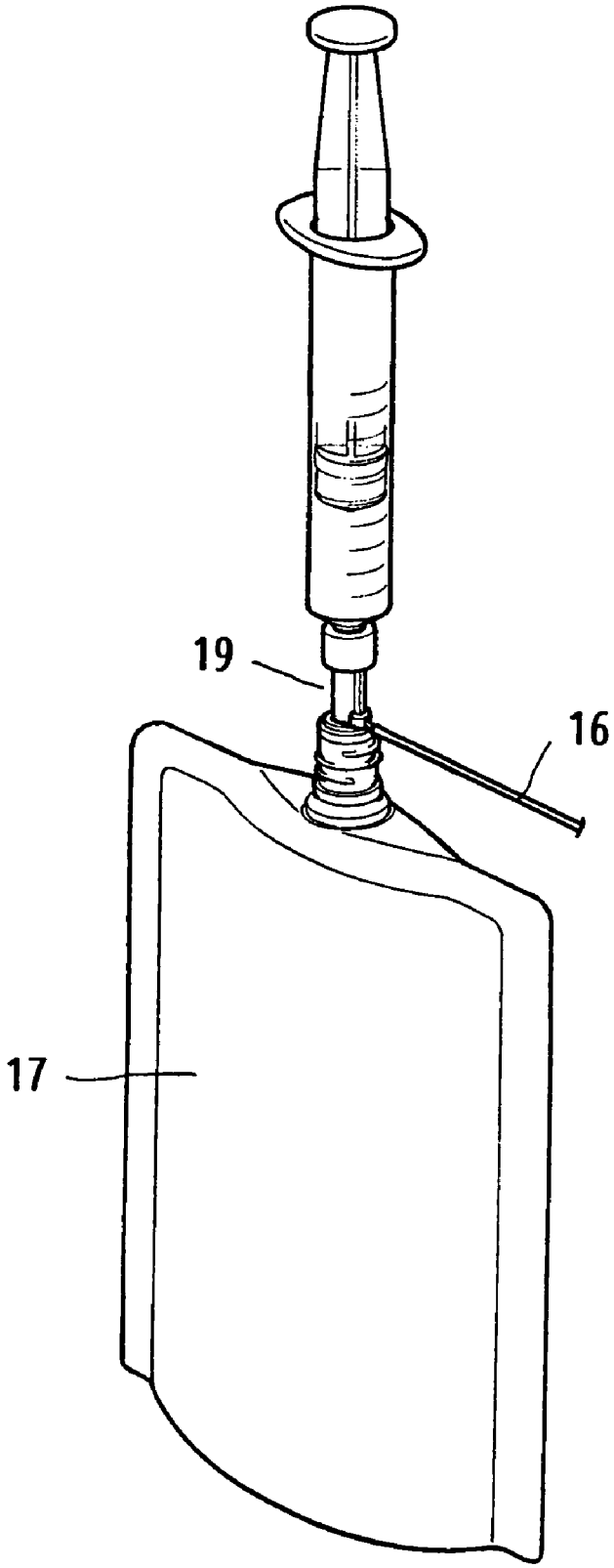
FIG. 11 is a perspective view of the present invention, showing the air in the aluminum foil bag being sucked out with a syringe.

Referring to FIGS. 6, 10, and 11 again, the ink bottle 17 is replaced with an ink bag made of aluminum foil; when the lid of the ink bag is opened, air would enter the aluminum foil bag, and the air therein would affect the printing quality. The balance device 19 and the outlet connector 43 mounted on the mouth of the ink bag are unable to have a spring 21 mounted thereon; therefore, a stronger spring 21 has to be mounted between the valve and valve base so as to provide a close contact function between the two parts. After the balance device 19 and the outlet 43 are mounted on the ink bag mouth, the air entered can be sucked out by means of a syringe, i.e., the syringe can be stabbed into the center through hole 60 of the outer lid 24 so as to separate the valve 22 and the valve base 23 from each other and to have the air in the ink bag sucked out; when the ink bag has no air, the ink will be fed steadily without being volatilized.

While the invention has been described with reference to specific embodiments it must be understood that those embodiments are susceptible to many changes, substitutions, and modifications that will be readily apparent to those having ordinary skill in the art without departing from the scope and spirit of the invention.

What is claimed is:

1. A tiny air-pressure balance device between an ink cartridge and an ink bottle, comprising:

an ink bottle having an outlet and a bottle mouth for refilling ink therein;

a balance device mounted on a top of said ink bottle; said balance device including:

a body portion closely mounted and sealed with said ink bottle; inside of said body portion furnished with a first cylinder body for receiving a spring and a second cylinder body for receiving a valve base;

the spring having a tiny resilient force, and being mounted on the first cylinder body in said body portion; one end of said spring pushed against a ring-shaped recess in said first cylinder body, while other end thereof pushed against a round surface of a valve;

the valve having the round surface at one end thereof to be in contact with a seal ring on a bottom of the valve base, while other end thereof having a flat surface with a valve rod having a suitable length; a short conic surface and a ring-shaped flat surface furnished between said valve rod and said valve flat surface;

the valve base mounted in a cylindrical hole of said second cylinder body on said body portion, and center thereof having a through hole with a seal ring, and said seal ring being in close contact with a spherical surface of said valve;

an outer lid having a round surface, and having a through hole in center thereof; said outer lid to be mounted over outer end of said body portion.

2. A tiny air-pressure balance device between an ink cartridge and an ink bottle as claimed in claim 1, wherein the outlet of said ink bottle is furnished under said ink bottle, and said outlet being connection with an ink cartridge on a printer by means of an ink tube.

3. A tiny air-pressure balance device between an ink cartridge and an ink bottle as claimed in claim 1, wherein said outlet of said ink bottle is furnished on an upper part of said ink bottle; said outlet mounted with a tube extended into said ink bottle, and outer end thereof being connected with a connector and an ink tube.

4. A tiny air-pressure balance device between an ink cartridge and an ink bottle as claimed in claim 1, wherein said body portion of said balance device is sealed together with said ink bottle; inside of said body portion being furnished with the cylinder first body for receiving the spring, and with the cylinder body for receiving a valve base.

5. A tiny air-pressure balance device between an ink cartridge and an ink bottle as claimed in claim 1, wherein said body portion is furnished with a plug rod on a lower part thereof, and said plug rod having a center through hole; the balance device mounted in said body portion; said balance device being plugged into a cylindrical hole on sail ink bottle.

6. A tiny air-pressure balance device between an ink cartridge and an ink bottle as claimed in claim 1, wherein the body portion of said balance device and the outlet of said ink bottle are mounted on a upper part of said ink bottle simultaneously; a lower body of said balance device having a plug rod with a center through hole, and inside of said body portion mounted with the balance device; said ink outlet mounted with a L-shaped connector which is then connected with an ink tube, while other end thereof being plugged in a cylindrical hole and a lower body of said balance device being also plugged in a separate cylindrical hole simultaneously.

7. A tiny air-pressure balance device between an ink cartridge and an ink bottle as claimed in claim 1, wherein said ink bottle is made of an aluminum foil bag, and the bottle mouth thereof being sealed with a seal member; upper part of said seal member having two through cylindrical holes to be plugged with a plug rod of said balance device and a plug rod of an ink outlet in a close sealed condition.

8. A tiny air-pressure balance device between an ink cartridge and an ink bottle as claimed in claim 1, wherein said ink bottle is made of an aluminum foil bag; the spring mounted in said balance device having a stronger resilience so as to have said valve and said valve base had a close contact condition.

* * * * *